United States Patent [19]

Waterman

[11] 4,306,362

[45] Dec. 22, 1981

[54] BLADE ASSEMBLY

[75] Inventor: Donald H. Waterman, New Gloucester, Me.

[73] Assignee: Valley Engineering, Inc., Gray, Me.

[21] Appl. No.: 148,662

[22] Filed: May 12, 1980

[51] Int. Cl.[3] ..... E01H 5/00

[52] U.S. Cl. ..... 37/41

[58] Field of Search ..... 37/50, 41, 42 R, 42 VL, 37/117.5; 172/782, 786, 777, 784

[56] References Cited

U.S. PATENT DOCUMENTS

| | | | |
|---|---|---|---|
| 2,085,996 | 7/1937 | Phillips | 37/42 R |
| 3,340,681 | 9/1967 | Strawbridge | 172/782 X |
| 3,477,151 | 11/1969 | Zanella | 37/42 R |
| 3,703,210 | 11/1972 | Williams | 37/50 |
| 4,019,268 | 4/1977 | Waterman | 37/41 X |
| 4,047,626 | 9/1977 | Meisel, Jr. | 37/187 X |
| 4,073,077 | 2/1978 | Essel | 37/50 |
| 4,249,323 | 2/1981 | Mathis et al. | 37/42 R |

*Primary Examiner*—E. H. Eickholt

*Attorney, Agent, or Firm*—Thompson, Birch

[57] ABSTRACT

A blade assembly for a tractor or other like vehicle of the type adapted for movement over snow covered terrain, having a horizontally extending first blade with second blades mounted at the opposite ends thereof for pivotal movement about vertical axes. Top plates are fixed relative to and extend forwardly from the first and second blades. The second blades are pivotally adjustable between open positions extending angularly outwardly from the first blade, and closed positions extending angularly inwardly from the first blade to cooperate therewith in defining an enclosure. The enclosure has a bottom opening defined by the lower edges of the blades, and a top opening which is smaller than the bottom opening and which is defined at least in part by the top plates.

8 Claims, 7 Drawing Figures

BLADE ASSEMBLY

BACKGROUND OF THE INVENTION

This invention relates generally to snow handling equipment, and in particular to an improved tractor-mounted apparatus which can be employed to pack snow into protective mounds around potentially dangerous obstacles, as well as to move snow from one location to another.

It is conventional practice in ski areas to encase potentially dangerous obstacles such as the legs of lift towers, light poles, etc. with specially designed protective pads. These pads are expensive, and because they are vulnerable to being damaged by ski poles, trail grooming equipment, etc., they must be replaced often, at a considerable cost to the operator of the ski area.

It is also known that the task of moving and handling snow is complicated in ski areas by a characteristically difficult terrain. More particularly, because of the relatively steep inclination of trails, access roads, etc., vehicular centers of gravity are shifted, thus making it much more difficult to maintain traction, particularly when the vehicles are being used to push or carry snow. This limits and sometimes precludes the use of conventional plows, front end loaders, etc. These problems are further aggravated by the need to maneuver between trees in the wooded areas which sometime border ski trails.

Accordingly, it is an object of the present invention to provide a tractor-mounted snow handling apparatus which can be employed to pack snow into protective mounds around potentially dangerous obstacles, thereby obviating the necessity to resort to expensive specially designed protective pads.

Another object of the present invention is to provide an improved tractor-mounted apparatus for moving snow from one location to another in a manner such that lifting is substantially avoided.

A further object of the present invention is the provision of a tractor-mounted snow moving apparatus which can be readily collapsed and expanded to facilitate maneuvering into and out of wooded areas when transferring snow from one location to another.

SUMMARY OF THE INVENTION

In accomplishing the foregoing objects, the present invention provides an improved blade assembly for a tractor or other like vehicle of the type adapted for movement over snow-covered terrain. The blade assembly has a horizontally extending central or first blade which is adapted for attachment to the tractor by any conventional means permitting adjustment in at least the vertical direction. Second blades are mounted to the opposite ends of the first blade for pivotal movement about vertical axes. Top plates extent forwardly from the first and second blades. An operating mechanism, typically consisting of a pair of hydraulic cylinders, is used to pivot the second blades between open positions extending angularly outwardly relative to the first blade, and closed positions cooperating with the first blade to define an enclosure. The enclosure has a large bottom opening defined by the bottom edges of the blades, and a relatively smaller top opening defined at least in part by the top plates.

When the blade assembly is in the open position, it can be advanced in a conventional manner to accumulate an amount of snow against the front surfaces of the blades. Thereafter, by pivoting the second blades into their closed positions, the accumulated snow will be confined and compacted within the aforesaid enclosure. Then the tractor can be moved to another area while dragging the closed blade assembly along the snow covered surface. Lifting is thus unnecessary. Thereafter, the blade assembly can be opened to deposit the snow at a desired location.

When packing snow around an obstacle, the open blade assembly first is advanced to push snow against the obstacle. Then, the second blades are closed, thus gathering and compacting snow around the obstacle within the aforesaid enclosure. The top opening accommodates upward protrusion of the obstacle, which frequently comprises the support leg of a lift tower, a light pole or the like. After compaction has been accomplished and the obstacle is encased within a protective mound of snow, the blade assembly is opened and withdrawn.

Preferably, the first and second blades have generally concave front faces with serrated bottom edges. The top plates on the second blades are preferably somewhat triangular in shape, thereby cooperating with the top plate on the first blade to define a generally rectangular top opening when the blade assembly is in its closed condition.

BRIEF DESCRIPTION OF THE DRAWINGS

These and other aspects of the invention will become more apparent after considering an illustrative embodiment taken in conjunction with the drawings in which.

DETAILED DESCRIPTION OF INVENTION

Figure 1:
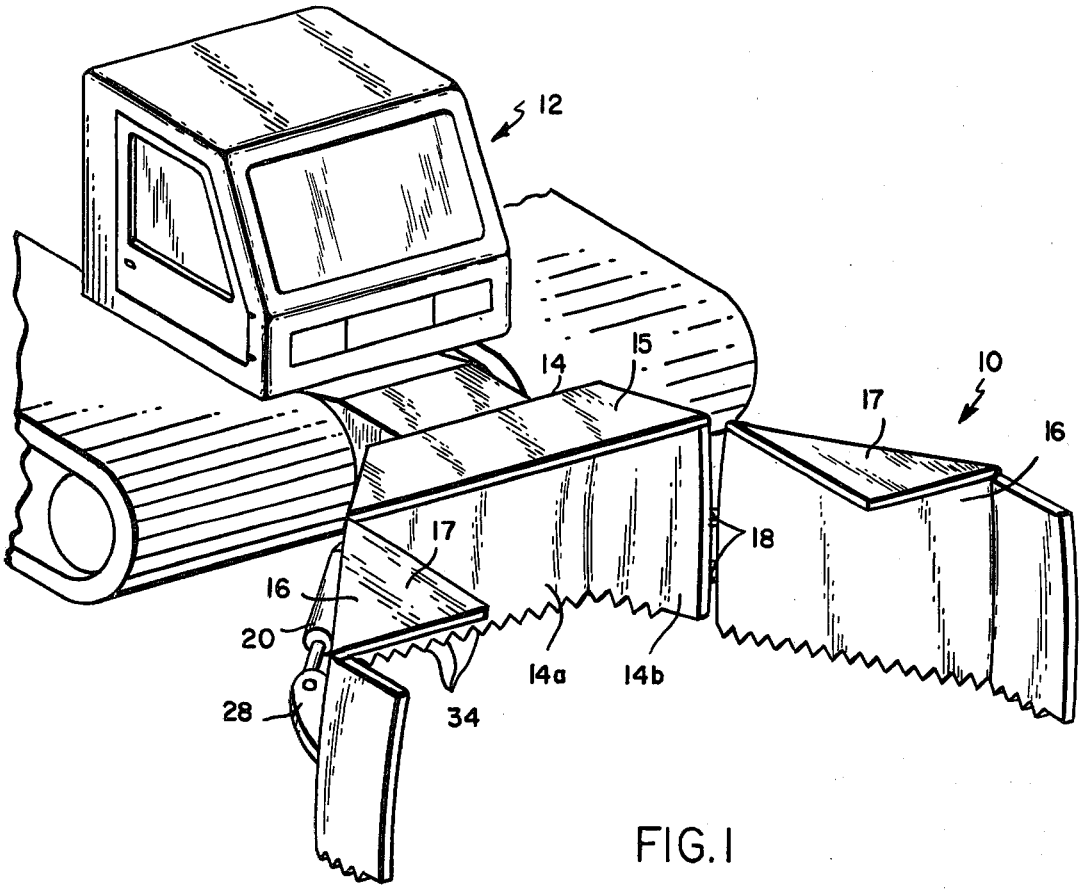
FIG. 1 is a perspective view of a blade assembly in accordance with the present invention mounted on the front end of a tractor and adjusted to the open position.
Figure 2:
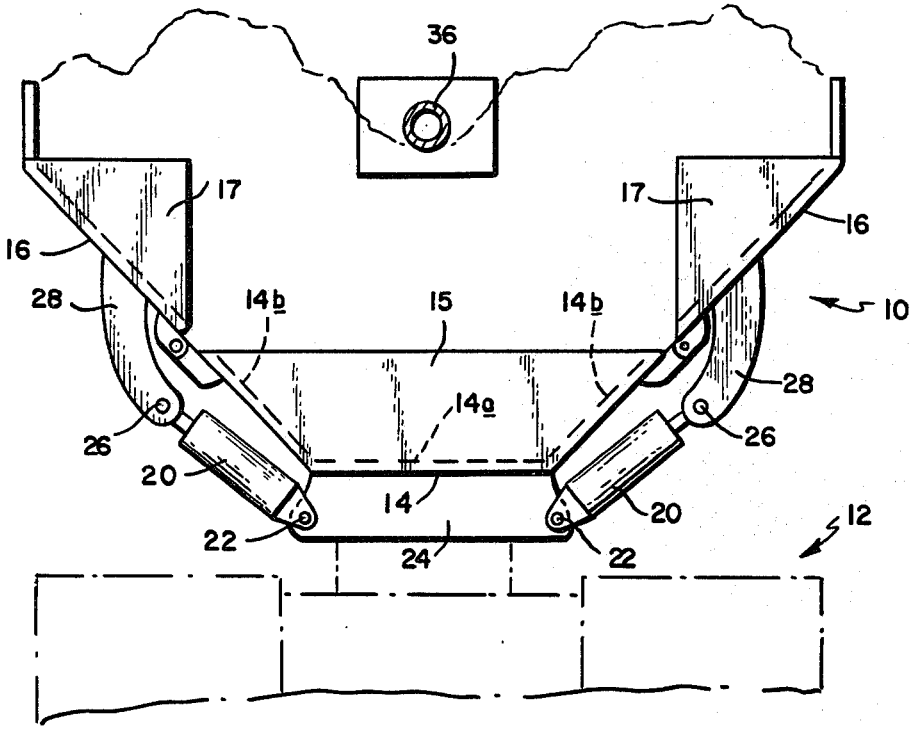
FIG. 2 is a plan view of the blade assembly of FIG. 1.
Figure 3:
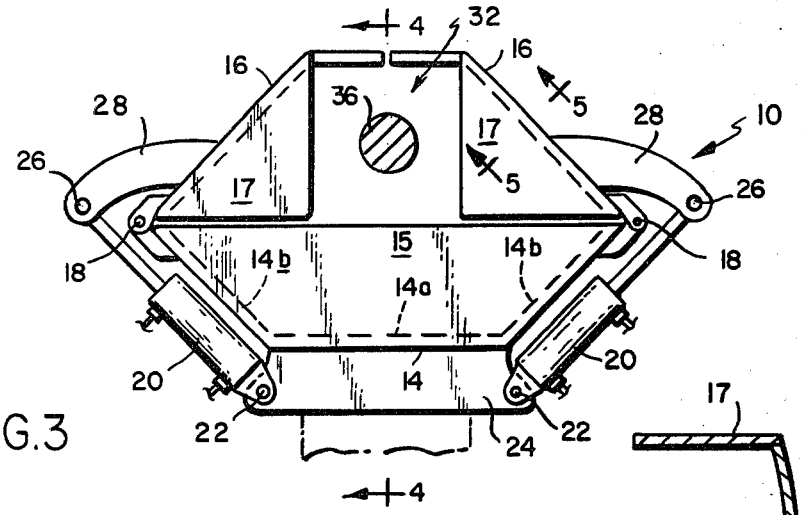
FIG. 3 is a plan view similar to FIG. 2 showing the blade assembly in the closed position compacting snow around an upstanding obstacle.

Referring initially to FIGS. 1–3, a blade assembly 10 in accordance with the present invention is shown mounted on the front end of a tractor 12 of the type adapted for movement over snow covered terrain. The blade assembly may be attached to the tractor by any known means permitting adjustment in at least the vertical direction. One such attachment means is shown, for example, in U.S. Pat. No. 3,822,751.

The blade assembly includes a horizontally extending first blade 14 having a straight section 14*a* with outwardly extending fixed side sections 14*b*. Second blades 16 are mounted at 18 at opposite ends of the first blade 14 for pivotal movement about vertical axes.

A top plate 15 extends forwardly from the first blade 14, and other top plates 17 extend forwardly from the second blades 16. Preferably, top plate 15 will be somewhat trapezoidal, and the top plates 17 will be generally triangular.

The second blades are pivotally adjusted by means of double-acting piston-cylinder units 20. Each piston-cylinder unit is pivotally attached at one end as at 22 to a cross bar 24 forming a part of the first blade 14, and at the other end as at 26 to a bracket 28 secured to the back side of a respective one of each second blade 16.

Figure 4:
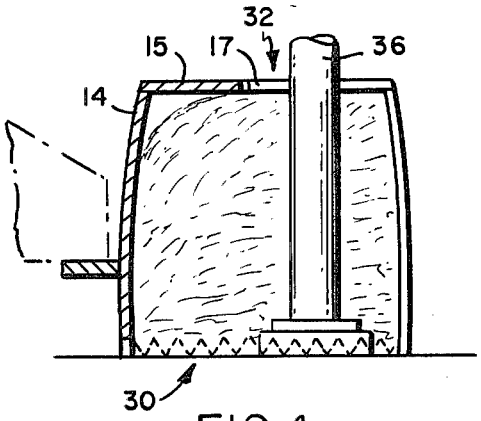
Figure 6:
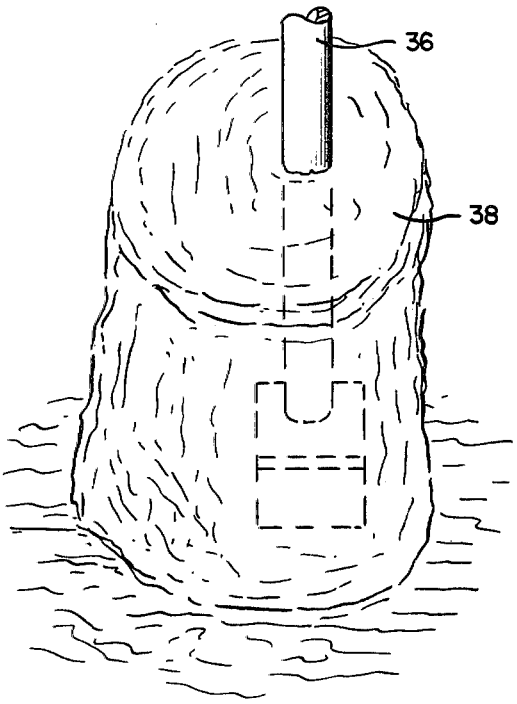
FIG. 6 is a perspective view showing a compacted protective mound of snow around an obstacle.

The piston-cylinder units 20 are operable to pivotally adjust the second blades 16 between open positions extending angularly outwardly from the first blade 14 as shown in FIGS. 1 and 2, and closed positions extending angularly inwardly from the first blade to cooperate therewith in defining an enclosure, as shown in FIGS. 3 and 4. When the second blades 16 are closed, the resulting enclosure has a bottom opening 30 defined by the lower edges of the first and second blades 14, 16, and a top opening 32 which is smaller than the bottom opening 30 and which is defined at least in part by the top plates 15, 17.

Figure 5:
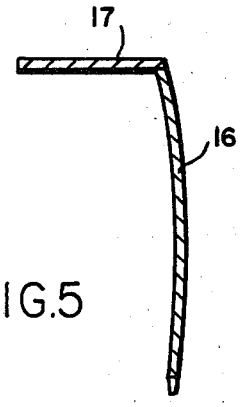
FIGS. 4 and 5 are sectional views taken along lines 4—4 and 5—5 of FIG. 3.

As can be best seen in FIGS. 3 and 5, the first and second blades 14, 16 preferably are arcuately shaped with concave front faces. The lower edges of the blades 14, 16 are preferably serrated as at 34 (see FIG. 1).

When employing the blade assembly to compact a protective mound of snow around an obstacle such as for example the pole 36 shown in the drawings, the second blades 16 are first pivoted to the open positions shown in FIGS. 1 and 2. The blade assembly is then lowered onto the surface of the snow. The tractor then moves forward, accumulating an amount of snow in advance of the open blades 14, 16. The serrated bottom edges of the blades assist in loosening compacted snow. The tractor is stopped when the front edge of top plate 15 approaches the pole 36, (compare FIGS. 2 and 3). At this point, the piston-cylinder units 20 are actuated to pivotally close the second blades 16, thus gathering and compacting the previously accumulated snow around the pole 36. Once this has been accomplished, the second blades are opened, and the tractor is backed away, leaving a protective snow mound 38 around the pole 36. This eliminates any necessity to resort to expensive specially designed pads or other like equipment to safeguard skiers from injury. The concave front surfaces of the blades assist in properly shaping the protective snow mound.

Figure 7:
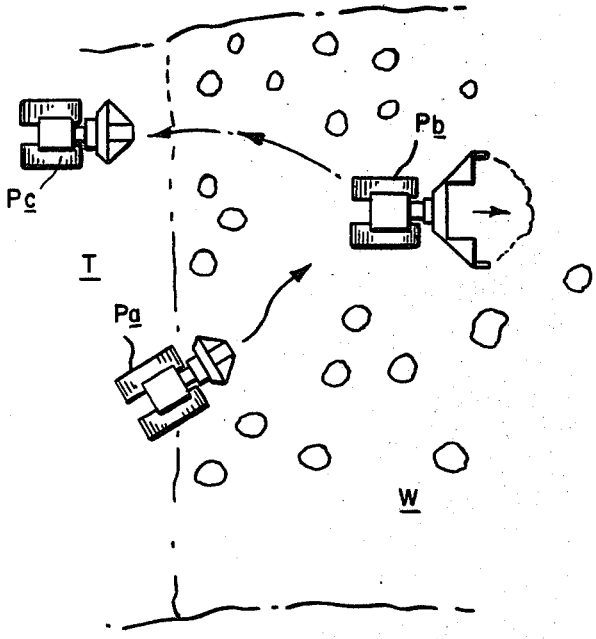
FIG. 7 is a schematic view illustrating the maneuverability of a vehicle employing a blade assembly in accordance with the present invention in a wooded area.

FIG. 7 schematically depicts how the blade assembly can be employed to transfer snow from a wooded area "W" onto a trail "T". More particularly, with the blade assembly in the closed position as shown at position $P_a$, the tractor can be maneuvered between closely spaced trees into a more open area, after which as shown at position $P_b$, the blade assembly can be opened, the tractor advanced, and the blade assembly again closed to confine an amount of snow within the enclosure defined by the blades 14, 16 and their associated top plates 15, 17. The top plates serve as a means of preventing the snow from escaping upwardly, except possibly for a limited amount which may be pushed through the smaller top opening 32. Once the blade assembly is closed, the tractor can be maneuvered back out through the same or another limited opening to a position $P_c$. During this movement, the blade assembly is dragged over the snow surface, thus preventing snow from escaping from the bottom enclosure opening 30. By moving the snow in this manner, lifting is avoided, thus making it easier for the tractor to maintain traction, particularly where the work is being performed on an inclined slope. At position $P_c$, the blade assembly is opened to deposit the snow in preparation for spreading by other equipment.

I claim:

1. A blade assembly for a tractor or other like vehicle of the type adapted for movement over snow covered terrain, comprising:

a horizontally extending first blade, second blades mounted at opposite ends of said first blade for pivotal movement about vertical axes, top plates fixed relative to and extending forwardly from said first and second blades, and means for pivotally adjusting said second blades between open positions extending angularly outwardly from said first blade, and closed positions extending angularly inwardly from said first blade to cooperate therewith in defining an enclosure, the said enclosure having a bottom opening defined by the lower edges of said blades and a top opening which is smaller than said bottom opening and which is defined at least in part by said top plates.

2. The apparatus of claim 1 wherein said second blades are arcuately shaped.

3. The apparatus of claim 1 wherein the lower edge of said blades are serrated.

4. The apparatus of claim 1 wherein the top plates on said second blades are triangular.

5. The apparatus of claim 1 wherein said first and second blades have generally concave front faces.

6. The apparatus of claim 1 wherein said means for pivotally adjusting said second blades comprises a pair of piston cylinder units, each unit being pivotally connected at one end to one of said second blades and at the opposite end to said first blade.

7. Snow handling apparatus for a tractor or other like vehicle of the type adapted for movement over snow covered terrain, comprising:

(a) a blade assembly having
  (i) a centrally arranged horizontally extending first blade,
  (ii) second blades mounted at opposite ends of said first blade for pivotal movement about vertical axes, and,
  (iii) top plates extending forwardly from said first and second blades;

(b) means for mounting said blade assembly on said tractor for adjustment in at least the vertical direction; and, (c) means for pivotally adjusting said second blades between open positions arranged at obtuse angles relative to said first blade and closed positions cooperating with said first blade to define an enclosure, the said enclosure having a bottom opening defined by the lower edges of said blades and a top opening which is smaller than said bottom opening and which is defined at least in part by said top plates.

8. A blade assembly for a tractor or other like vehicle of the type adapted for movement over snow covered terrain, comprising a first horizontally extending blade, second blades mounted at opposite ends of said first blade for pivotal movement about vertical axes, said first and second blades having generally concave front surfaces and serrated bottom edges, with generally triangular top plates extending forwardly from said second blades; and, means for pivotally adjusting said second blades between open positions arranged at obtuse angles relative to said first blade, and closed positions cooperating with said first blade to define an enclosure, the said enclosure having a bottom opening defined by the lower edges of said blades and a top opening which is smaller than said bottom opening and which is defined at least in part by said top plates.

* * * * *